US009200605B2

(12) United States Patent
Kim et al.

(10) Patent No.: US 9,200,605 B2
(45) Date of Patent: Dec. 1, 2015

(54) APPARATUS FOR PREVENTING CAVITATION DAMAGE TO A DIESEL ENGINE FUEL INJECTION PUMP

(75) Inventors: Dong-Hun Kim, Ulsan (KR); Seung-Hyup Ryu, Ulsan (KR); Sang-Hak Ghal, Ulsan (KR); Sang-Lip Kang, Seoul (KR); Ju-Tae Kim, Ulsan (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 801 days.

(21) Appl. No.: 13/126,041

(22) PCT Filed: Oct. 23, 2009

(86) PCT No.: PCT/KR2009/006146

§ 371 (c)(1), (2), (4) Date: May 25, 2011

(87) PCT Pub. No.: WO2010/050703

PCT Pub. Date: May 6, 2010

(65) Prior Publication Data

US 2011/0259302 A1 Oct. 27, 2011

(30) Foreign Application Priority Data

Oct. 27, 2008 (KR) ..... 10-2008-0105086

(51) Int. Cl.
*F02M 59/46* (2006.01)
*F02M 59/26* (2006.01)
*F02M 63/00* (2006.01)

(52) U.S. Cl.
CPC ..... *F02M 59/265* (2013.01); *F02M 59/26* (2013.01); *F02M 63/005* (2013.01); *F02M 2200/04* (2013.01)

(58) Field of Classification Search
CPC ..... F02M 55/001; F02M 59/26–59/28; F02M 59/44; F02M 63/005; F02M 45/066; F02M 2200/04; F02M 45/06; F02M 45/063; F02M 2200/315
USPC ..... 123/299, 495–497, 506, 510; 417/494, 417/498, 499; 239/533.3
See application file for complete search history.

(56) References Cited

U.S. PATENT DOCUMENTS 2,551,053 A * 5/1951 Rogers ..... 417/565
2,575,955 A * 11/1951 Hatch ..... 417/308

(Continued)

FOREIGN PATENT DOCUMENTS

AT 413865 B * 4/2006
DE 822453 C * 11/1951

(Continued)

OTHER PUBLICATIONS

International Search Report—PCT/KR2009/006146 dated Apr. 28, 2010.

*Primary Examiner* — Mahmoud Gimie
*Assistant Examiner* — John Zaleskas
(74) *Attorney, Agent, or Firm* — Rabin & Berdo, P.C.

(57) ABSTRACT

An apparatus for preventing cavitation damage to a diesel engine fuel injection pump comprises a valve member mounted on a barrel port to shut the barrel port during an early stage of fuel compression performed by the upward movement of a plunger to increase the pressure in the barrel port, a valve housing installed in the deflector or the barrel of a pump housing to support the valve member, and a pressure control valve constituted by a spring interposed between the valve member and the valve housing to elastically support the valve member. The barrel port is shut to increase the pressure therein during the early stage of fuel compression, and when the pressure of fuel in the barrel port exceeds a level higher than an open level, the barrel port opens to discharge fuel.

3 Claims, 5 Drawing Sheets

(56) References Cited

U.S. PATENT DOCUMENTS

| | | | | | |
|---|---|---|---|---|---|
| 2,871,796 | A | * | 2/1959 | Dreisin et al. | 417/494 |
| 3,371,610 | A | * | 3/1968 | De Luca et al. | 417/485 |
| 3,440,964 | A | * | 4/1969 | Voigt | 417/494 |
| 3,592,568 | A | * | 7/1971 | Fenne | 417/430 |
| 3,759,239 | A | * | 9/1973 | Regneault et al. | 123/506 |
| 3,963,384 | A | * | 6/1976 | Bastenhof | 417/499 |
| 4,211,203 | A | * | 7/1980 | Kobayashi | 123/387 |
| 4,271,805 | A | * | 6/1981 | Kobayashi et al. | 123/459 |
| 4,378,775 | A | * | 4/1983 | Straubel et al. | 123/458 |
| 4,426,198 | A | * | 1/1984 | Bastenhof et al. | 417/494 |
| 4,526,149 | A | * | 7/1985 | Hafele et al. | 123/447 |
| 4,526,150 | A | * | 7/1985 | Guntert et al. | 123/447 |
| 4,535,742 | A | * | 8/1985 | Laufer et al. | 123/447 |
| 4,577,606 | A | * | 3/1986 | Bohringer et al. | 123/506 |
| 4,957,418 | A | * | 9/1990 | Pischinger et al. | 417/494 |
| 5,015,160 | A | * | 5/1991 | Hlousek et al. | 417/499 |
| 5,178,110 | A | * | 1/1993 | Guggenbichler et al. | 123/300 |
| 5,478,213 | A | * | 12/1995 | Harris et al. | 417/308 |
| 5,961,304 | A | * | 10/1999 | Parenti et al. | 417/500 |
| 6,016,790 | A | * | 1/2000 | Makino et al. | 123/496 |
| 6,568,927 | B1 | * | 5/2003 | Guentert | 417/569 |
| 7,415,973 | B2 | * | 8/2008 | Yoshizumi et al. | 123/495 |
| 7,677,872 | B2 | * | 3/2010 | Beardmore | 417/569 |
| 2004/0096346 | A1 | * | 5/2004 | Usui et al. | 417/470 |
| 2009/0068041 | A1 | * | 3/2009 | Beardmore | 417/540 |
| 2009/0178649 | A1 | * | 7/2009 | Koivunen et al. | 123/457 |

FOREIGN PATENT DOCUMENTS

| | | | | |
|---|---|---|---|---|
| EP | 877163 | A1 | * | 11/1998 |
| EP | 0877163 | A1 | * | 11/1998 |
| EP | 1411238 | A1 | * | 4/2004 |
| FR | 51141 | E | * | 8/1941 |
| GB | 1281308 | A | * | 7/1972 |
| GB | 2116643 | A | * | 9/1983 |
| GB | 2269209 | A | * | 2/1994 |
| GB | 2269426 | A | * | 2/1994 |
| JP | 62-035057 | | | 2/1987 |
| JP | 05018335 | A | * | 1/1993 |
| JP | 1993-340322 | | | 12/1993 |
| JP | 06272638 | A | * | 9/1994 |
| JP | 1994-336962 | | | 12/1994 |
| JP | 1995-054735 | | | 2/1995 |
| JP | 1995-269442 | | | 10/1995 |
| JP | 08296528 | A | * | 11/1996 |
| JP | 1999-270431 | | | 10/1999 |
| JP | 11270431 | A | * | 10/1999 |
| JP | 2001289139 | A | * | 10/2001 |
| JP | 2003293905 | A | * | 10/2003 |
| JP | 2003328897 | A | * | 11/2003 |
| JP | 2005-069036 | | | 3/2005 |
| JP | 2005069036 | A | * | 3/2005 |
| KR | 10-2006-0117567 | | | 11/2006 |
| WO | 98/48166 | | | 10/1998 |

* cited by examiner

APPARATUS FOR PREVENTING CAVITATION DAMAGE TO A DIESEL ENGINE FUEL INJECTION PUMP

TECHNICAL FIELD

The present invention relates, in general, to an apparatus for preventing cavitation damage to a fuel injection pump of a diesel engine and, more particularly, to an apparatus for preventing cavitation damage to a fuel injection pump of a diesel engine, in which a pressure control valve is mounted to a surface of a deflector or a barrel of the fuel injection pump, thus preventing fountain- or jet-type cavitation from occurring before and after the opening of a barrel port during a late stage of fuel compression, thereby preventing damage caused by cavitation occurring mainly in a plunger and the barrel port.

BACKGROUND ART

Generally, diesel engines are internal combustion engines that draw air into a cylinder, compress the air to increase the temperature and pressure thereof, and inject a liquid fuel to the high temperature and high pressure air, thus causing spontaneous combustion and operating a piston, therefore obtaining power. The diesel engines may be classified into a direct injection type, a pre-combustion chamber type, a swirl chamber type, and an air chamber type according to the fuel inflow method. Among them, the direct injection type directly injects fuel into a combustion chamber under high pressure, and a fuel injection device of this type mainly includes a fuel injection pump, a fuel valve (injector), and a connecting pipe. Further, a unit injector that is constructed so that a fuel injection pump is coupled directly with an injector is also used as the fuel injection device.

A fuel injection pump is a machine that compresses fuel to high pressure and then transmits the fuel to the injector. In order to improve combustion performance and reduce exhaust gas, there has been a recent trend to increase the pressure of the injected fuel. This causes cavitation erosion in the barrel port of the barrel and the plunger constituting the fuel injection pump, thus bringing about a serious problem. That is, cavitation occurs even when fuel is injected under relatively low pressure, but the intensity of the cavitation is weak, so the degree of damage is not serious. Further, the damage occurs partially. Thus, by improving the design and changing the material of a damaged part according to the damage shape, it is possible to easily establish damage prevention measures. However, as the fuel injection pressure becomes high, the intensity of the cavitation also increases, so that cavitation damage occurs compositely in the barrel port of the barrel and the plunger, and the degree of damage also becomes very serious. However, in the prior art, the cause of cavitation damage has not been clearly investigated, so there are attempts to prevent cavitation damage using changes in design or materials based on existing experience.

For example, Korean Patent Laid-Open Publication No. 2001-0020139 discloses a fuel injection pump, in which an orifice member is installed in each change hole formed in a wall of a barrel to form considerably increased pressure in a space between the orifice member and a plunger, thus preventing cavitation from occurring in an area adjacent to the upper edge of the plunger. Further, Japanese Patent Laid-Open Publication No. Hei. 7-269442 postulates that damage to a plunger is caused by interrelation between a jet and the shape of a fuel outflow hole, and discloses a cavitation preventing apparatus for a fuel injection pump, which prevents damage to a plunger by forming a small hole for collapsing a cavity adjacent to the fuel outflow hole of a barrel. Japanese Patent Laid-Open Publication No. Hei. 7-54735 postulates that a cavity occurs and remains right before a barrel port is closed during a fuel intake process, and thereafter shock waves generated by a collision between fuel discharged from the barrel port and a deflector collide with the remaining cavity, thus leading to cavitation damage, and discloses a spill deflector for an internal combustion engine which is constructed so that a receiving hole opened or closed depending on the pressure of the discharged fuel is formed in an end of the deflector and fuel introduced through the receiving hole is dispersed to the outside of a barrel. Further, Japanese Patent Laid-Open Publication No. Hei. 5-340322 does not clarify the cause of cavitation damage, but asserts that the damage is caused by air bubbles remaining in a barrel port. This publication discloses a fuel injection device for an internal combustion engine, which is constructed so that a protective member having a fuel flow hole shaped to prevent the air bubbles from staying is provided on the outer portion of the barrel port, and fuel discharged from the barrel port when fuel injection is completed collides obliquely with the inner surface of the fuel flow hole of the protective member.

As such, in order to solve the cavitation damage that occurs compositely in the barrel port of the barrel and the plunger as the fuel injection pressure becomes high, various design improving methods have been proposed. However, these methods rely mainly on experience of damage shape without clearly revealing the cause of damage, so fundamental measures are not suggested.

DISCLOSURE

Technical Problem

Accordingly, the present invention has been made keeping in mind the above problems occurring in the prior art, and an object of the present invention is to provide an apparatus for preventing cavitation damage to a fuel injection pump of a diesel engine, wherein a pressure control valve for shutting a barrel port is mounted on a deflector or a barrel of the fuel injection pump to increase fuel pressure in the barrel port during an early stage of fuel compression. This prevents fountain-type or jet-type cavitation from occurring before and after the opening of the barrel port during a late stage of fuel compression, thereby preventing erosion damage caused by cavitation occurring mainly in a plunger and the barrel port of the fuel injection pump.

Technical Solution

In order to accomplish the above object, the present invention provides an apparatus for preventing cavitation damage to a fuel injection pump of a diesel engine having a fuel intake valve and a barrel port for inflow and outflow of fuel, respectively. The apparatus includes a pressure control valve including a valve member which is disposed in the barrel port to open or close the barrel port and shuts the barrel port during an early stage of fuel compression performed by upward movement of a plunger, thus increasing pressure in the barrel port; a valve housing which is mounted to a deflector of a pump housing or a barrel to support the valve member; and a spring which is interposed between the valve member and the valve housing and elastically supports the valve member. This shuts the barrel port during the early stage of fuel compression to increase the pressure of the barrel port, thus preventing cavitation from occurring because of a difference in pressure between the barrel port and a pump chamber before and after the barrel port is opened during the late stage of fuel compression, and opens the barrel port if fuel pressure in the barrel port exceeds opening pressure, thus discharging the fuel. Further, an apparatus for preventing cavitation damage to a fuel injection pump of a diesel engine according to the present invention includes a pressure control valve including a valve member which is disposed in a barrel port to open or close the barrel port in the fuel injection pump of the diesel engine and has a path that makes a pump chamber communicate with a fuel supply chamber, a valve housing which is mounted to a deflector of a pump housing to support the valve member, and a spring which is interposed between the valve member and the valve housing and elastically supports the valve member, whereby the pressure control valve shuts the barrel port to increase pressure of the barrel port during an early stage of fuel compression, and opens the barrel port if fuel pressure in the barrel port exceeds opening pressure; and a check valve including a ball which is provided in the valve member to open or close the path of the valve member, and a spring which is provided in the valve member to elastically support the ball, whereby the check valve permits flow of the fuel in a direction opposite to the pressure control valve.

Further, an apparatus for preventing cavitation damage to a fuel injection pump of a diesel engine according to the present invention includes a pressure control valve including a valve member which is disposed in a barrel port to open or close the barrel port in the fuel injection pump of the diesel engine and shuts the barrel port during an early stage of fuel compression performed by upward movement of a plunger, thus increasing pressure in the barrel port, a valve housing which is mounted to a deflector of a pump housing or a barrel to support the valve member, and a spring which is interposed between the valve member and the valve housing and elastically supports the valve member, whereby the pressure control valve shuts the barrel port to increase pressure of the barrel port during the early stage of fuel compression, and opens the barrel port if fuel pressure in the barrel port exceeds opening pressure; and a fuel inlet port which is provided at a position adjacent to the barrel port and makes a fuel supply chamber communicate with a pump chamber, thus functioning to introduce the fuel, the fuel inlet port being opened later than the barrel port during termination of fuel injection. The present invention having the above characteristics shuts the barrel port using the pressure control valve during the early stage of fuel compression, thus increasing the pressure of fuel in the barrel port and thereby thoroughly preventing the fountain-type cavitation and the jet-type cavitation from occurring before and after the barrel port is opened during the late stage of fuel compression, therefore preventing erosion damage from occurring in the plunger or barrel port.

Figure 1:
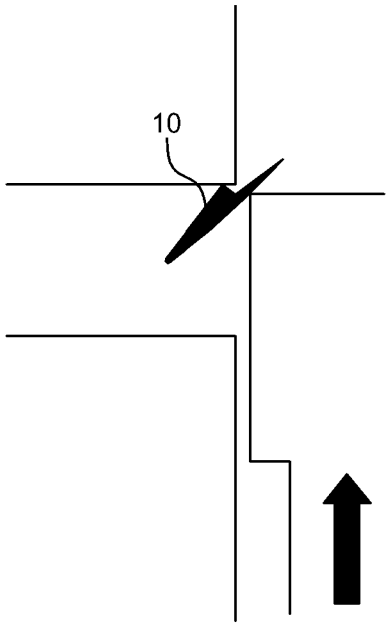
FIG. 1 is a view showing jet-type cavitation that occurs during an early stage of fuel compression of a fuel injection pump.

<Description of reference characters of important parts>

| | |
|---|---|
| (101): pump housing | (102): barrel |
| (103): plunger | (104): barrel port |
| (105): fuel intake valve | (106): deflector |
| (110): pressure control valve | (111): valve member |
| (112): valve housing | (113): spring |
| (210): pressure control valve | (211): valve member |
| (211-1): path | (212): valve housing |
| (213): spring | (220): check valve |
| (221): ball | (222): spring |
| (310): pressure control valve | (311): valve member |
| (312): valve housing | (313): spring |
| (320): fuel inlet port | |

MODE FOR INVENTION

Hereinafter, the preferred embodiments of the present invention will be described in detail with reference to the accompanying drawings. When it is determined that the detailed description of the known art related to the present invention may obscure the gist of the present invention, the detailed description will be omitted.

Figure 2:
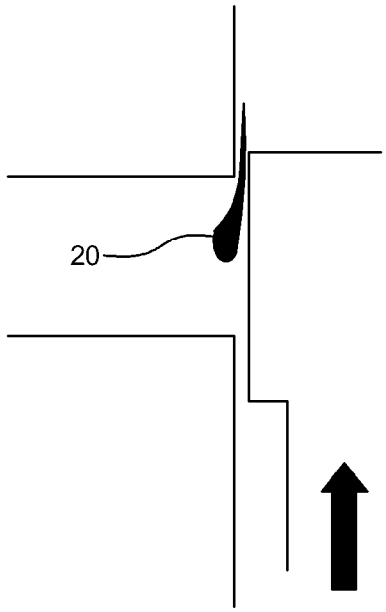
FIG. 2 is a view showing waterfall-type cavitation that occurs during the early stage of the fuel compression of the fuel injection pump.
Figure 3:
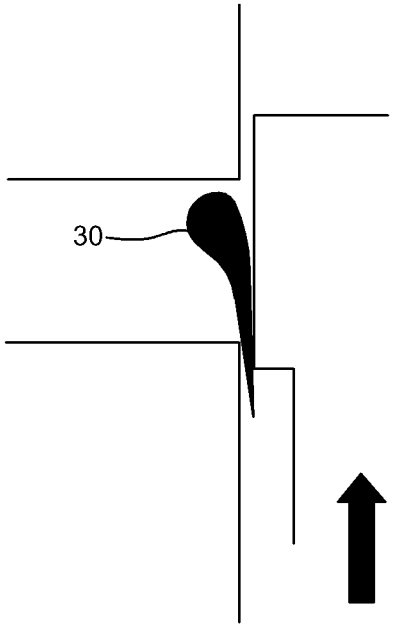
FIG. 3 is a view showing fountain-type cavitation that occurs before a barrel port is opened during a late stage of the fuel compression of the fuel injection pump.
Figure 4:
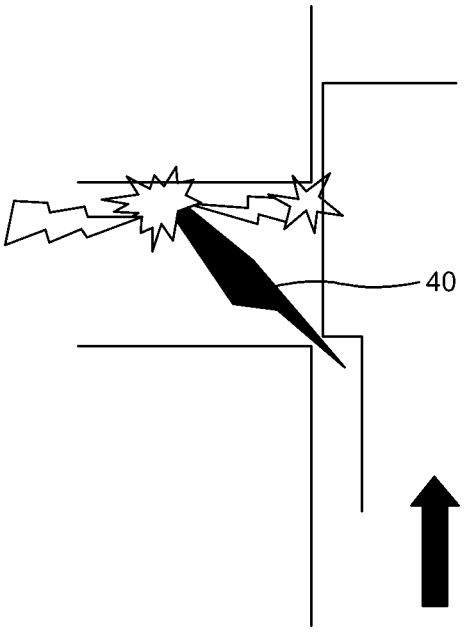
FIG. 4 is a view showing jet-type cavitation that occurs after the barrel port is opened during the late stage of the fuel compression of the fuel injection pump.

FIG. 1 is a view showing jet-type cavitation that occurs before a barrel port is closed during an early stage of fuel compression of a fuel injection pump, FIG. 2 is a view showing waterfall-type cavitation that occurs after the barrel port is closed during the early stage of the fuel compression of the fuel injection pump, FIG. 3 is a view showing fountain-type cavitation that occurs before a barrel port is opened during a late stage of the fuel compression of the fuel injection pump, and FIG. 4 is a view showing jet-type cavitation that occurs after the barrel port is opened during the late stage of the fuel compression of the fuel injection pump.

Jet-type cavitation 10 and waterfall-type cavitation 20 occurring during the early stage of fuel compression of the fuel injection pump do not cause a large problem because the pressure of the fuel injection pump is relatively low and thereby the intensity and amount of the cavitation are small. However, since fountain-type cavitation 30 occurring before the barrel port is opened during the late stage of fuel compression occurs when the pressure of the fuel is high, a large amount of cavities are formed along the wall of a plunger, and such cavities remain around a surface of the plunger. Meanwhile, since jet-type cavitation 40 occurring after the barrel port is opened during the late stage of fuel compression occurs when the fuel injection pressure is maximal, the intensity of cavitation is high and the flow rate is very high. Thus, this jet-type cavitation directly damages the barrel port, and causes a sudden rise in pressure as soon as fuel collides with the barrel port. Such a rise in pressure collapses the cavities formed around the plunger by the fountain-type cavitation 30, thus causing damage to the plunger.

The present invention clarifies the cause of erosion damage due to cavitation, and shuts the barrel port using a pressure control valve so as to prevent damage caused by cavitation, thus increasing the pressure of fuel in the barrel port during the early stage of fuel compression and thereby thoroughly preventing the fountain-type cavitation 30 and the jet-type cavitation 40 from occurring before and after the barrel port is opened during the late stage of fuel compression.

Meanwhile, the pressure control valve installed to shut the barrel port is similar to the known pressure control valve, that is, it completely prevents the fuel from flowing in one direction and permits the fuel to flow in the other direction only when satisfying the condition that the pressure exceeds the opening pressure. That is, the pressure control valve of the present invention is constructed so that the inflow of fuel from a fuel supply chamber to a pump chamber is completely blocked, and the outflow of fuel from the pump chamber to the fuel supply chamber is permitted only when the fuel pressure exceeds the opening pressure of the pressure control valve.

The general function of the pressure control valve remains the same in the first embodiment, the second embodiment, and the third embodiment that will be described below. However, as for the first embodiment, the pressure control valve is applied to a fuel injection pump having a fuel intake valve in place of the barrel port that loses a fuel inflow function because of the installation of the pressure control valve. As for the second embodiment, a check valve is provided in the pressure control valve in an opposite direction thereof, thus enabling the inflow of fuel through the barrel port. As for the third embodiment, a fuel inlet port for introducing fuel is provided at a position adjacent to the barrel port. Hereinafter, the respective embodiments will be described in detail with reference to the accompanying drawings.

FIRST EMBODIMENT

Figure 5:
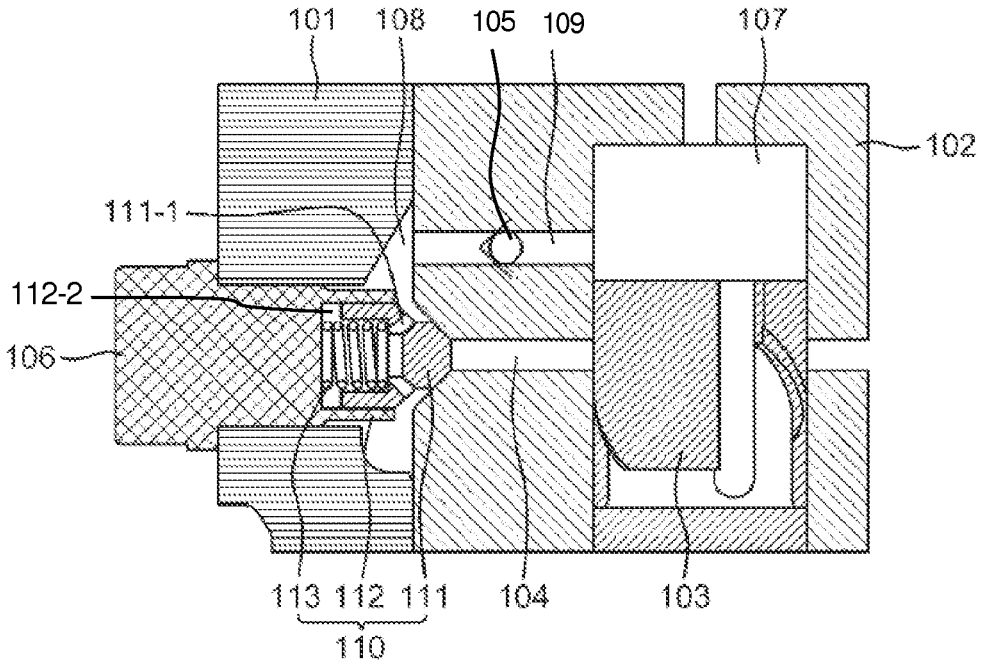
FIG. 5 is sectional view showing important parts of a fuel injection pump equipped with an apparatus for preventing cavitation damage according to a first embodiment of the present invention.

FIG. 5 is sectional view showing important parts of a fuel injection pump equipped with an apparatus for preventing cavitation damage according to the first embodiment of the present invention.

The apparatus for preventing cavitation damage according to the first embodiment of the present invention is applied to a fuel injection pump having a fuel intake valve 105 in a fuel inlet port 109 for the inflow of fuel and a barrel port 104 for the outflow of fuel. As such, the fuel injection pump having the fuel intake valve 105 and the barrel port 104 includes a fuel injection pump of a diesel engine that is mainly used for a large vessel. FIG. 5 shows the configuration wherein the fuel intake valve 105 is provided in the fuel inlet port 109 on a side surface of the fuel injection pump.

Meanwhile, the apparatus for preventing cavitation damage according to the first embodiment includes a pressure control valve 110 having a valve member 111, a valve housing 112, and a spring 113. The valve member 111 is disposed between the barrel port 104 and the valve housing 112 and moved by the pressure of fuel in a pump chamber 107 or the elastic force of the spring 113, thus opening or shutting the barrel port 104.

The valve housing 112 functions to support the valve member 111, and may be mounted to a deflector 106 of a pump housing 101. Meanwhile, FIG. 5 shows the configuration wherein a recess 112-2 for the insertion of the valve member 111 is formed in the deflector 106 so that the valve housing 112 is integrated with the deflector 106.

The valve housing 112 supports the valve member 111 in such a way that the valve member 111 is movable to open the barrel port 104 when the fuel pressure in the barrel port 104 exceeds the opening pressure. The spring 113 is interposed between the valve member 111 and the valve housing 112 to elastically support the valve member 111. Since the opening pressure of the pressure control valve 110 is controlled by the elastic force of the spring 113, the spring 113 having an appropriate elastic force is selected and used to set the fuel pressure in the barrel port 104 to a desired design pressure during the early stage of fuel compression.

The opening pressure of the pressure control valve 110 controlled by the above spring 113 is preferably determined in consideration of a pressure condition that suppresses the generation of cavitation and a pressure condition that does not considerably affect fuel injection characteristics while the fuel is discharged through the barrel port 104 to the fuel supply chamber 108 during the termination of fuel injection. Meanwhile, a plurality of balance holes 111-1 are formed in the valve member 111 to balance the internal pressure and the external pressure of the valve housing 112.

The operation of the fuel injection pump equipped with the pressure control valve 110 constructed as described above is as follows.

When a plunger 103 moves down, fuel is drawn through the fuel intake valve 105 into the pump chamber 107. The fuel flowing into the pump chamber 107 fills the interior of the barrel port 104 that is shut at an outlet thereof by the pressure control valve 110. Meanwhile, if the plunger 103 is moved up by a cam (not shown) and the fuel starts to be compressed, the internal pressure of the pump chamber 107 increases, and the fuel flowing into the barrel port 104 is compressed to increase its pressure, similar to the fuel of the pump chamber 107, before a pre-stroke when the barrel port 104 is shut by the plunger 103. At this time, if the fuel pressure is more than the opening pressure of the pressure control valve 110 that shuts the barrel port 104, the valve is opened. In contrast, if the fuel pressure is less than the opening pressure, the valve is closed. Thus, the fuel pressure in the barrel port 104 becomes a pressure that is slightly lower than the opening pressure of the pressure control valve 110. When the plunger 103 continues to move up and the fuel compression reaches the late stage, the fountain-type cavitation causing the cavitation damage to the plunger 103 occurs along a wall of the plunger 103 before the plunger 103 reaches an effective stroke. According to the present invention, the barrel port 104 is shut by the pressure control valve 110 so that the fuel in the barrel port 104 is under high pressure. Thus, the occurrence of the fountain-type cavitation itself is prevented so that the erosion damage to the wall of the plunger 103 by the cavitation can be prevented.

Further, after the plunger 103 reaches the effective stroke, high pressure fuel in the pump chamber 107 flows suddenly out to the barrel port 104, and jet-type cavitation occurs. This causes damage to the barrel port 104, the deflector 106, etc. However, according to the present invention, the fuel in the barrel port 104 is under high pressure because of the pressure control valve 110, so that the occurrence of the jet-type cavitation itself is prevented, and thus erosion damage to the barrel port 104 or the deflector 106 caused by the cavitation can be prevented.

Meanwhile, the above-mentioned effective stroke means the compression stroke of the fuel from the moment when the barrel port 104 is closed by the upper portion of the plunger 103 during the early stage of fuel compression to the moment when the barrel port 104 is opened again by a lower lead groove 103-2 of the plunger 103 during the late stage of the fuel compression.

As such, the pressure control valve 110 shutting the barrel port 104 is operated such that the valve member 111 is moved to open the barrel port 104 when the fuel pressure in the barrel port 104 is increased and exceeds the opening pressure by high pressure fuel discharged to the barrel port 104 after the effective stroke of the plunger 103, thus discharging fuel remaining in the pump chamber 107 to the fuel supply chamber 108 and completing the fuel injection process.

When the fuel injection process is completed as such, the pressure control valve 110 is opened, thus buffering the high speed flow of the fuel, therefore mitigating erosion damage caused by the high speed flow.

Figure 6:
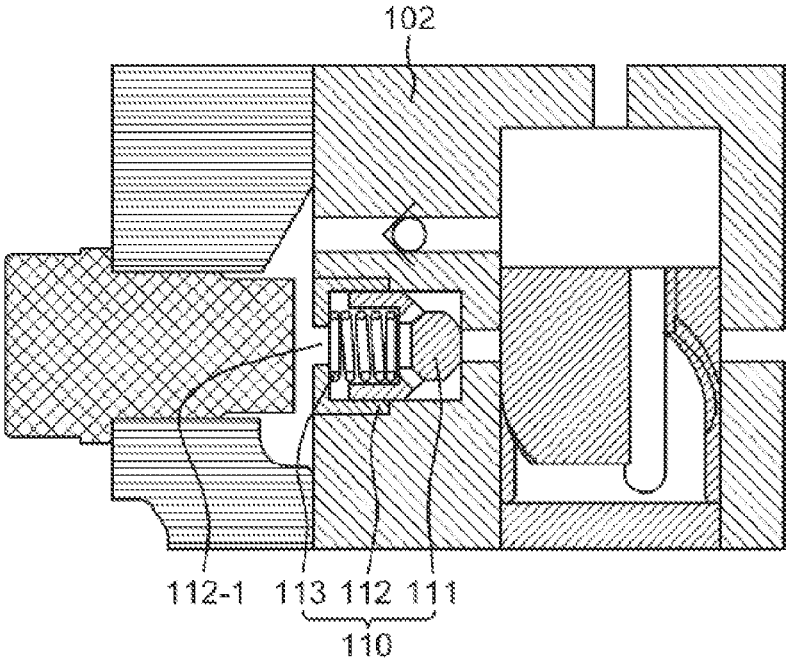
FIG. 6 is sectional view showing important parts of the fuel injection pump, in which the apparatus for preventing cavitation damage according to the first embodiment of the present invention is mounted to a barrel.

FIG. 6 is a sectional view showing the important parts of the fuel injection pump that is constructed such that the apparatus for preventing cavitation damage according to the first embodiment of the present invention is mounted to a barrel. The above cavitation damage preventing apparatus according to the first embodiment may be mounted to the barrel 102 if there is sufficient space for mounting the pressure control valve 110 to the barrel 102 of the fuel injection pump. Here, the pressure control valve 110 includes the valve member 111, the valve housing 112, and the spring 113, and shuts the barrel port 104 to increase the pressure of the barrel port 104, thus preventing cavitation from occurring in the same manner as the above-mentioned construction and operation. However, unlike the above construction and operation, a path 112-1 is further formed in the valve housing 112 to discharge fuel to the fuel supply chamber 108 when the barrel port 104 is opened by the movement of the valve member 111.

SECOND EMBODIMENT

Figure 7:
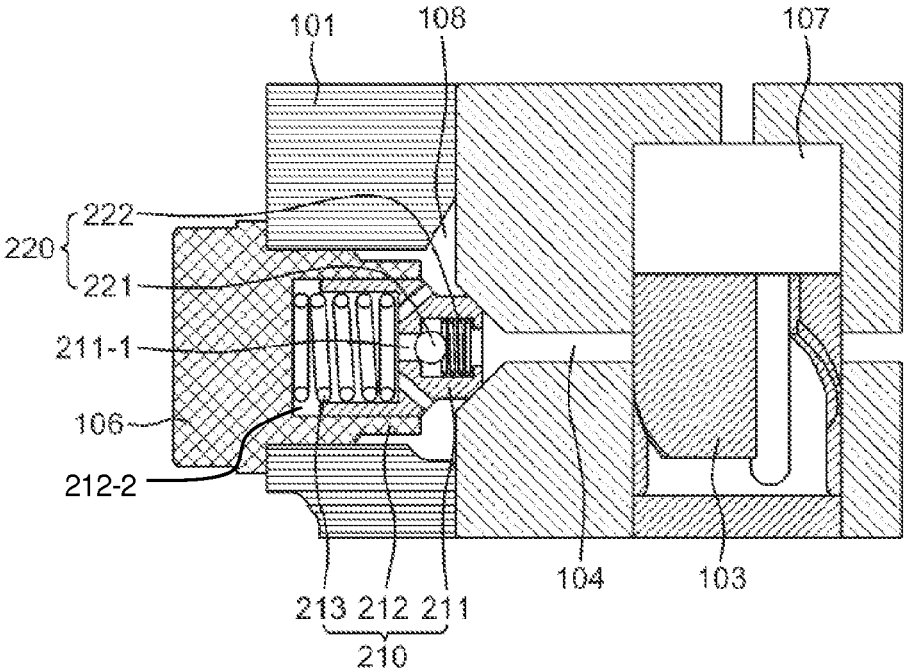
FIG. 7 is sectional view showing important parts of a fuel injection pump equipped with an apparatus for preventing cavitation damage according to a second embodiment of the present invention.

FIG. 7 is a sectional view showing important parts of a fuel injection pump equipped with an apparatus for preventing cavitation damage according to a second embodiment of the present invention. The cavitation damage preventing apparatus according to the second embodiment of the present invention is applied to a fuel injection pump that introduces and discharges fuel through a barrel port, in the case where the fuel injection pump has no fuel intake valve or it is required to introduce the fuel through the barrel port 104 so as to control a fuel injection time. Such a cavitation damage preventing apparatus according to the second embodiment includes a pressure control valve 210 that is mounted to open or close the barrel port 104, and a check valve 220 that is provided in the pressure control valve 210 to permit the inflow of fuel through the barrel port 104.

The pressure control valve 210 is disposed to open or close the barrel port 104, and includes a valve member 211 having a path 211-1 through which a fuel supply chamber 108 communicates with a pump chamber 107, a valve housing 212 which is mounted to a deflector 106 of a pump housing 101 and has a recess 212-2 to support the valve member 211, and a spring 213 which is provided between the valve member 211 and the valve housing 212. The check valve 220 functions to open or close the path in a direction opposite to the pressure control valve 210. When the fuel pressure in the fuel supply chamber 108 reaches the opening pressure, the check valve opens the path 211-1 provided in the valve member 211, thus supplying fuel from the fuel supply chamber 108 to the pump chamber 107, and preventing fuel from being discharged from the pump chamber 107 through the path 211-1 provided in the valve member 211. Such a check valve 220 includes a ball 221 that is provided in the valve member 211 to open or close the path 211-1 provided in the valve member 211, and a spring 222 that is provided in the valve member 211 to elastically support the ball 221.

The cavitation damage preventing apparatus of the second embodiment constructed as such is operated as follows: while the plunger 103 moves down to draw the fuel, the pressure of the pump chamber 107 is reduced to be lower than the pressure of the fuel supply chamber 108, thus moving the ball 221, therefore opening the path 221-1 of the valve member 211 and introducing the fuel through the barrel port 104.

In contrast, when the plunger 103 moves up to inject fuel, pressure in the barrel port 104 increases, so that the check valve 220 shuts the path 211-1 of the valve member 211. If the path 211-1 of the valve member 211 is shut by the check valve 220 while the plunger 103 moves up for the injection of the fuel, the pressure control valve 210 performs the same operation as the pressure control valve 110 of the above-mentioned first embodiment, thus preventing erosion damage caused by cavitation.

THIRD EMBODIMENT

Figure 8:
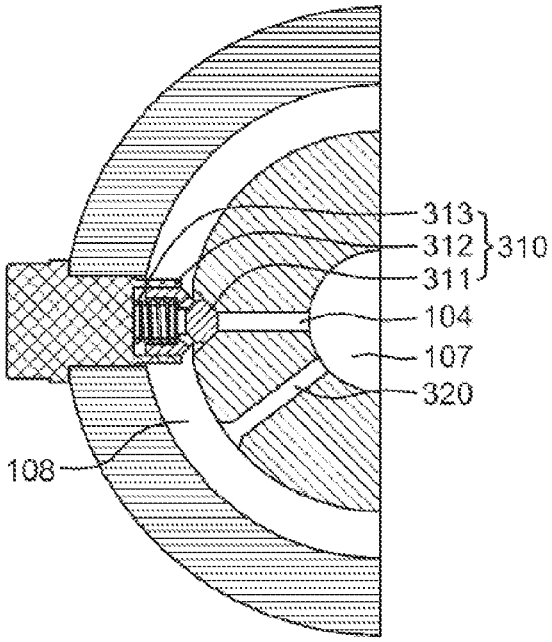
FIG. 8 is sectional view showing important parts of a fuel injection pump equipped with an apparatus for preventing cavitation damage according to a third embodiment of the present invention.

FIG. 8 is a sectional view showing important parts of a fuel injection pump equipped with an apparatus for preventing cavitation damage according to a third embodiment of the present invention.

The cavitation damage preventing apparatus according to the third embodiment of the present invention is applied to a fuel injection pump which is difficult to ensure a space for mounting a check valve in a pressure control valve in an opposite direction thereof, although the fuel injection pump has no fuel intake valve or it is required to introduce the fuel through the barrel port 104 so as to control a fuel injection time as in the second embodiment. The cavitation damage preventing apparatus according to the third embodiment includes a pressure control valve 310 that is provided to open or close the barrel port 104, and a fuel inlet port 320 that is provided to be adjacent to the barrel port 104 shut by the pressure control valve 310, thus supplying the fuel from a fuel supply chamber 108 to a pump chamber 107.

Meanwhile, the pressure control valve 310 includes a valve member 311, a valve housing 312, and a spring 313. Since the construction of the pressure control valve 310 remains the same as in the first embodiment, the detailed description of the construction and operation will be omitted. The fuel inlet port 320 makes the fuel supply chamber 108 communicate with the pump chamber 107, thus introducing fuel, and is formed to be opened later than the barrel port 104 during the termination of fuel injection.

Figure 9:
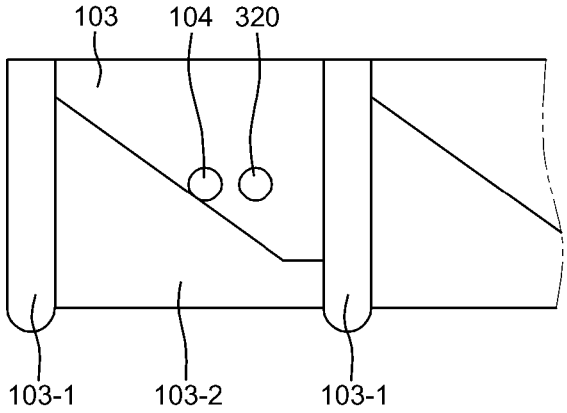
FIG. 9 is a development view of a plunger for clearly illustrating the position of a fuel inlet port according to the present invention.

FIG. 9 is a development view of a plunger for clearly illustrating the position of the fuel inlet port according to the present invention. A vertical groove 103-1 and a lead groove 103-2 are formed on the outer portion of the plunger 103 of the fuel injection pump. The vertical groove 103-1 and the lead groove 103-2 function to connect the pump chamber 107 to the barrel port 104, so that fuel is discharged from the pump chamber 107 to the fuel supply chamber 108 during the termination of fuel injection.

Meanwhile, the lead groove 103-2 is formed on the outer portion of the plunger 103 in such a way as to be obliquely inclined. If the fuel inlet port 320 is formed to be located to the right of or above the barrel port 104 when viewed in the drawing, in consideration of the structure of the lead groove 103-2, high pressure fuel is discharged through the barrel port 104 that is first opened by the lead groove 103-2 immediately after the effective stroke of the plunger 103. At this time, the pressure control valve 110 shutting the barrel port 104 suppresses the occurrence of cavitation.

Meanwhile, since the fuel inlet port 320 is opened after most of the fuel is discharged through the barrel port 104, the danger of cavitation damage caused by the outflow of the high pressure fuel is eliminated.

Figure 10:
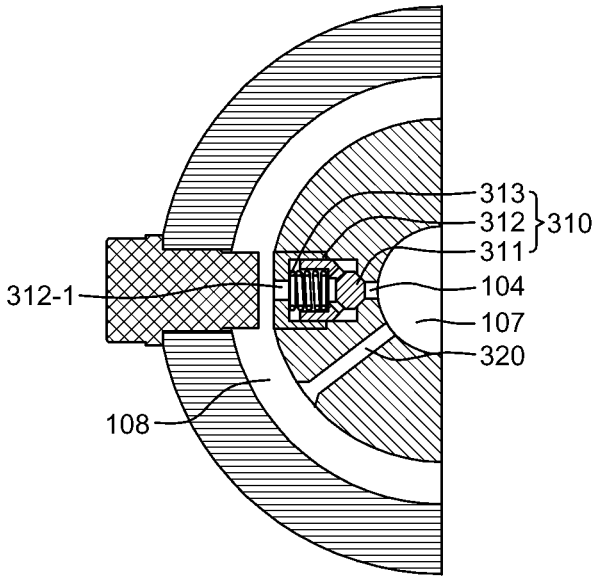
FIG. 10 is a sectional view showing a structure of the fuel injection pump, in which the apparatus for preventing cavitation damage according to the third embodiment of the present invention is mounted to the barrel.

FIG. 10 is a sectional view showing the important parts of the fuel injection pump that is constructed such that the cavitation damage preventing apparatus according to the third embodiment of the present invention is mounted to a barrel. Such a cavitation damage preventing apparatus according to the third embodiment may be constructed so that the pressure control valve 310 is mounted to the barrel 102 when the barrel 102 of the fuel injection pump has sufficient space for mounting the pressure control valve 310. Here, the pressure control valve 310 includes the valve member 311, the valve housing 312, and the spring 313, and shuts the barrel port 104 to increase the pressure of the barrel port 104 and thereby prevent the occurrence of cavitation, as in the above-mentioned construction and operation. However, according to this embodiment, the valve housing 312 further includes a path 312-1 to discharge fuel to the fuel supply chamber 108, when the barrel port 104 is opened by the movement of the valve member 311.

Although the preferred embodiments of the present invention have been disclosed for illustrative purposes, those skilled in the art will appreciate that various modifications, additions, and substitutions are possible without departing from the scope and spirit of the invention as disclosed in the accompanying claims.

The invention claimed is:

1. An apparatus for preventing cavitation damage to a fuel injection pump of a diesel engine, the apparatus comprising:
- the fuel injection pump having
  - a fuel inlet port provided in a side wall of a barrel and introducing fuel from a fuel supply chamber to a pump chamber, the fuel inlet port having a first opening directly open to the fuel supply chamber and a second opening directly open to the pump chamber and having a straight line shape entirely from the first opening to the second opening, the fuel inlet port including a fuel intake valve therein, and
  - a barrel port provided in the side wall of the barrel and discharging the fuel from the pump chamber to the fuel supply chamber, the barrel port being separated from the fuel inlet port through its entire length such that the fuel flows therethrough only in a direction from the pump chamber to the fuel supply chamber;
- a deflector fixed in a pump housing and having a first side exposed to the fuel supply chamber and a second side exposed to an exterior of the fuel injection pump, the deflector including
  - a valve housing disposed in the first side of the deflector and integral with the deflector, and
  - a first recess formed in a central portion of the valve housing; and
- a pressure control valve including
  - a valve member having
    - a body part disposed inside the first recess of the valve housing, having a second recess in a central portion of the body part and moving in the first recess along an inside wall of the valve housing,
    - a head part integrally formed on the body part and opening or closing an entire section of the barrel port, and
    - a balance hole formed between the body part and the head part and directly connecting the second recess of the body part and the fuel supply chamber to balance an internal pressure and an external pressure of the valve housing,
    - wherein the valve member shuts the barrel port during an early stage of fuel compression performed by upward movement of a plunger, thus increasing pressure in the barrel port, and
  - a spring interposed between the second recess of the valve member and the first recess of the deflector and elastically supporting the valve member,
- whereby the pressure control valve shuts the barrel port to increase pressure of the barrel port during the early stage of fuel compression, and opens the barrel port if fuel pressure in the barrel port exceeds opening pressure.

2. An apparatus for preventing cavitation damage to a fuel injection pump of a diesel engine, comprising:
- a deflector fixed in a pump housing and having a first side exposed to a fuel supply chamber and a second side exposed to an exterior of the fuel injection pump, the deflector including
  - a valve housing disposed in the first side of the deflector and integral with the deflector, and
  - a first recess formed in a central portion of the valve housing;
- a pressure control valve including
  - a valve member having
    - a body part disposed inside the first recess of the valve housing, having a second recess in a central portion of the body part and moving in the first recess along an inside wall of the valve housing,
    - a head part integrally formed on the body part and opening or closing a barrel port in the fuel injection pump of the diesel engine, the head part having
      - a third recess formed in a central portion of the head part, and
      - a path connecting the third recess of the head part and the second recess of the body part, and
    - a balance hole formed between the body part and the head part and directly connecting the second recess of the body part and the fuel supply chamber,
  - a first spring interposed between the second recess of the valve member and the first recess of the deflector and elastically supporting the valve member,
  - whereby the pressure control valve shuts the barrel port to increase pressure of the barrel port during an early stage of fuel compression, and opens the barrel port if fuel pressure in the barrel port exceeds opening pressure; and
- a check valve installed inside the third recess of the valve member of the pressure control valve and including
  - a ball provided inside the third recess of the valve member and opening or closing the path of the valve member, and
  - a second spring provided inside the third recess of the valve member and elastically supporting the ball,
  - whereby the check valve permits fuel to flow in a direction from the fuel supply chamber to the pump chamber.

3. An apparatus for preventing cavitation damage to a fuel injection pump of a diesel engine, the apparatus comprising:

a deflector fixed in a pump housing and having a first side exposed to a fuel supply chamber and a second side exposed to an exterior of the fuel injection pump, the deflector including a valve housing disposed in the first side of the deflector and integral with the deflector, and a first recess formed in a central portion of the valve housing;

a pressure control valve including a valve member having a body part disposed inside the recess of the valve housing; having a second recess in a central portion of the body part and moving in the first recess along an inside wall of the valve housing, a head part integrally formed on the body part and opening or closing an entire section of a barrel port in the fuel injection pump of the diesel engine, and a balance hole formed between the body part and the head part and directly connecting the second recess of the body part and the fuel supply chamber, wherein the valve member shuts the barrel port during an early stage of fuel compression performed by upward movement of a plunger, thus increasing pressure in the barrel port, the barrel port being provided in a side wall of a barrel, and a spring interposed between the second recess of the valve member and the first recess of the deflector and elastically supporting the valve member, whereby the pressure control valve shuts the barrel port to increase pressure of the barrel port during the early stage of fuel compression, and opens the barrel port if fuel pressure in the barrel port exceeds opening pressure; and a fuel inlet port provided separately from the barrel port at a position adjacent to the barrel port such that an imaginary extension line of a central axis of the fuel inlet port forms an acute angle with an imaginary extension line of a central axis of the barrel port, the fuel inlet port having a first opening directly open to the fuel supply chamber and a second opening directly open to a pump chamber and having a straight line shape entirely from the first opening to the second opening, the fuel inlet port making the fuel supply chamber communicate with the pump chamber, thus functioning to introduce fuel, the fuel inlet port being opened later than the barrel port during termination of fuel injection, wherein the fuel inlet port does not include any valve member therein.

* * * * *